US005957276A

United States Patent [19]

Cutler et al.

[11] Patent Number: 5,957,276

[45] Date of Patent: Sep. 28, 1999

[54] FOOD AND BEVERAGE CARRIER

[75] Inventors: Donna Cutler, Kirkland; Per-Axel Lindstrom, Seattle; Joseph Carmichael, Kirkland, all of Wash.

[73] Assignee: CLK Factor, Inc., Kirkland, Wash.

[21] Appl. No.: 09/062,394

[22] Filed: Apr. 17, 1998

Related U.S. Application Data

[63] Continuation-in-part of application No. 08/757,825, Nov. 27, 1996, Pat. No. 5,743,389, which is a continuation-in-part of application No. 08/501,148, Jul. 11, 1995, abandoned.

[51] Int. Cl.[6] ..... B65D 75/00

[52] U.S. Cl. ..... 206/194; 206/427; 229/117.14

[58] Field of Search ..... 206/152, 153, 206/154, 155, 168, 139, 140, 199, 200, 216, 194, 427, 549; 229/117.14, 120.18, 120.21, 186, 904, 932; 53/134.1, 413; 493/88, 909; 294/87.2

[56] References Cited

U.S. PATENT DOCUMENTS

| | | | |
|---|---|---|---|
| 1,140,540 | 5/1915 | Smith . | |
| 1,367,174 | 1/1921 | Botnen . | |
| 1,425,068 | 8/1922 | Sutherland | 229/186 |
| 1,448,866 | 3/1923 | Redoute . | |
| 1,981,647 | 11/1934 | Johnson . | |
| 1,983,010 | 12/1934 | Spees . | |
| 1,997,343 | 4/1935 | Quagliotti | 229/186 |
| 2,023,852 | 10/1935 | Oser . | |
| 2,238,545 | 4/1941 | Whiley . | |
| 2,513,762 | 7/1950 | Tyson, Jr. . | |
| 3,140,037 | 7/1964 | Baum et al. | 229/186 |
| 3,608,949 | 9/1971 | Owen . | |
| 3,640,380 | 2/1972 | Huffman . | |
| 4,033,489 | 7/1977 | Fowler . | |
| 4,184,595 | 1/1980 | Wackerman . | |
| 4,189,088 | 2/1980 | Rappolt et al. | 229/186 |
| 4,196,807 | 4/1980 | Brom . | |
| 4,397,393 | 8/1983 | Pergande . | |
| 4,399,939 | 8/1983 | Tumick . | |
| 5,127,519 | 7/1992 | Tsao . | |
| 5,205,474 | 4/1993 | Stuart . | |
| 5,423,478 | 6/1995 | Roosa . | |
| 5,464,150 | 11/1995 | Porres Sanchez . | |
| 5,564,583 | 10/1996 | Kelley . | |
| 5,685,478 | 11/1997 | Tang . | |

FOREIGN PATENT DOCUMENTS

| | | |
|---|---|---|
| 114538 | 7/1969 | Denmark . |

*Primary Examiner*—David T. Fidei
*Attorney, Agent, or Firm*—Paul L. Griffiths

[57] ABSTRACT

A paperboard blank storable in a flat condition ready for folding into a dual-configuration food and beverage carrier, selectively folded into an upright box with upward-extending handle panels and end walls with the handle panels extending from a box base around side walls and meeting over the box as a handle or alternatively into an inverted box with downwardly-extending side and end walls with handle panels extending from he base upward and away from the side walls. When the handle panels are folded toward and around the base side walls, the carrier is disposed to enclose foodstuffs placed in the carrier and simultaneously capable of carrying one or two cups placed through appropriately sized openings in the base. A box-like structure is created by handle panels and first and second side panels, the side panels and handle panels being connected by a plurality of webs attached to one of the side panels and an adjoining handle panel such that when the handle panels are urged in an upright direction the side panels are pulled up to form the box-like structure, or vic-versa. Cup stabilizers may be provided that hinge down into position from the handle panels over the box-like structure for supporting cups placed in the box.

12 Claims, 7 Drawing Sheets

FOOD AND BEVERAGE CARRIER

This is a continuation-in-part of Ser. No. 08/757,825 filed Nov. 27, 1996, now U.S. Pat. No. 5,743,389, which was a continuation-in-part of Ser. No. 08/501,148, filed Jul. 11, 1995, now abandoned.

BACKGROUND OF THE INVENTION

1. Field of the Invention

The present invention relates to food and beverage vessel, or cup, carriers and more particularly to foldable paperboard carriers with cup holders and a handle.

2. Background Information

It is known in the art to have paperboard food and cup carriers. Such carriers are common for carrying food and drinks from a food provider, such as a fast food restaurant or a sports stadium. It is customary that such carriers provide at least one opening for holding a cup. Above and attached to the base is commonly a handle panel comprising a panel extending up the middle of the base with holes for cups on each side of the panel with a hole near the top of the panel through which a user's hand can pass in carrying the carrier.

With cups that hold beverages carried outside the handle panel, fluid from the cups may easily spill from the cups. Foodstuffs fall from carriers lacking enclosing side walls. None of the previous paperboard folding cup carriers have splash protection and enclosing side walls.

It is also unknown to have a collapsible, dual-configuration carrier which serves as a food and beverage carrier in one configuration and as a sturdy beverage cup carrier when folded into a second configuration. Previous collapsible paperboard carriers are well suited for the purpose they were designed. Each may have its own advantage. For example, carriers may have apertures in a base for receiving beverage cups, which is convenient for its use but is less advantageous for use as a food carrier. Conversely, carriers may have an integral box without openings for receiving food stuffs but are less suited for use as a beverage carrier without a way to stabilize cups in the carrier.

An object of the present invention is to provide a carrier versatile in use as either an integral upright box without cup openings and adaptable to receive and stabilize cups in the box. Another object of the invention is to have a paperboard blank that is generally flat in a stored condition and easily folded into a sturdy carrier when in use. It is yet another object of the present invention to provide a foodstuffs carrier supported at its bottom for strength and stability. It is a further object that the carrier include a handle from which the carrier hangs. It is also an object of the present invention that the carrier provides a bottom strengthened to prevent collapse or folding under a load of cups and also supported by handles from which the carrier hangs during use.

SUMMARY OF THE INVENTION

These objects are achieved in a food and beverage carrier of this invention which presents a dual-configuration, collapsible food carrier, adapted as a side-walled carrier when folded into a first configuration and as a beverage cup or ice cream cone carrier when folded into a second configuration. The carrier is typically formed from flat paper stock cut and marked with fold lines for ease in assembly of a carrier with splash protection with a stable base section supported by two handle panels hinged respectively from opposite sides of the base joining at their distal ends to form a triangular structure over the base. In the first configuration, the box is upright, and the handle panels fold upward around the upright box, the box forming a tray with walls around its perimeter to retain foodstuffs placed therein. Independently from foodstuff retaining walls, the carrier is supported by the handles at its base where the carrier load is focussed while separately providing enclosing side and end walls.

In the second configuration, the handle panels hinge from the base sides and are disposed to fold over cups (or cones) placed in holes in the base with the carrier essentially comprising an inverted box hanging from its base from the handle panels and strengthened by circumferential side and end walls depending downward from the base to assure structural integrity of the carrier under heavy load conditions. That is, in the second configuration, the side and end walls prevent the base from collapsing or folding when loaded by strengthening the base ends.

In another embodiment, a carrier is efficiently produced from paperboard stock and is simpler to fold into an in-use condition. A bottom panel has a handle panel attached to each of two opposite edges thereof and a side panel attached to the other edges. The side panels each include a web that extends beyond the bottom panel's edges. Each web includes a diagonal fold line. In a stored condition the side panels are folded over the bottom panel and generally in contact therewith. A portion of each web is attached to each handle panel with another portion overlying each handle panel. A cup stabilizer ring is attached to either an edge of that portion of each web that is attached to the handle panel or to a handle panel itself. In operation as either the handle panels or the side panels are pushed or pulled in an upright direction the other panels are urged into position by action of the webs folding onto themselves along the diagonal fold line. Once in an upright position the cup stabilizers may be folded down into a position above the bottom panel, each stabilizer having an appropriately sized opening for receiving a cup. In preferred form, the bottom panel, handle panels, and side panels are integral being cut from a single sheet of paperboard. Each side panel is also integral with its pair of webs with an edge of each web also being integral with a handle panel. A triangular portion of each web being glued to its respective handle panel. The cup stabilizers are also integral, along a fold line, with their respective webs. In this manner only one cutting die is required with four triangular portions of the webs being glued to respective side panels.

In another embodiment, only one side panel is used. That side panel having a pair of webs attached to its outer edges and is connected to an opposite side panel via a cup stabilizing panel, the opposite side panel being attached to the bottom panel at its lower edge and to the cup stabilizing panel at its upper edge. In this embodiment each side panel is made integral with the bottom panel, the webs are integral with a respective side panel and handle panels, the opposite side panel is integral with the bottom panel and the cup stabilizing panel is integral to one side panel and glued to a tab on an opposite side panel. As the handle panels are urged into an upright position, the webs fold along their diagonal fold lines and push the side panel up into position which also pulls the opposite side panel into position via the cup stabilizing panel.

In all of the above embodiments, a box-like structure is formed having handle panels extending upwardly from a bottom panel providing superior strength and stability. The handle panels extend upwardly above the box-like structure to provide a convenient single handle for carrying while protecting the contents.

BRIEF DESCRIPTION OF THE DRAWINGS

In the drawings, like reference characters designate like parts throughout the several views, and.

DESCRIPTION OF THE PREFERRED EMBODIMENTS

Figure 1:
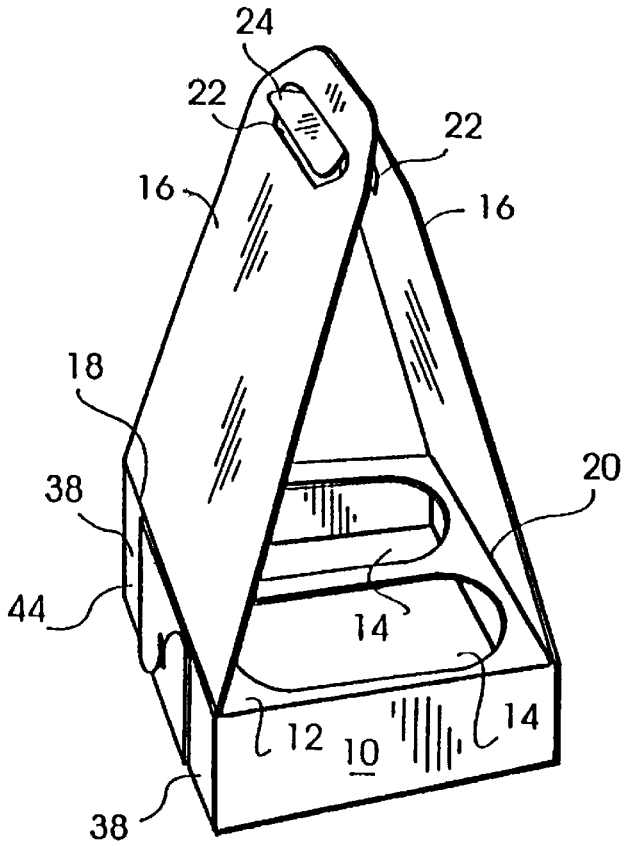
FIG. 1 is a front perspective view of an assembled beverage vessel carrier in a first and primary configuration.
Figure 2:
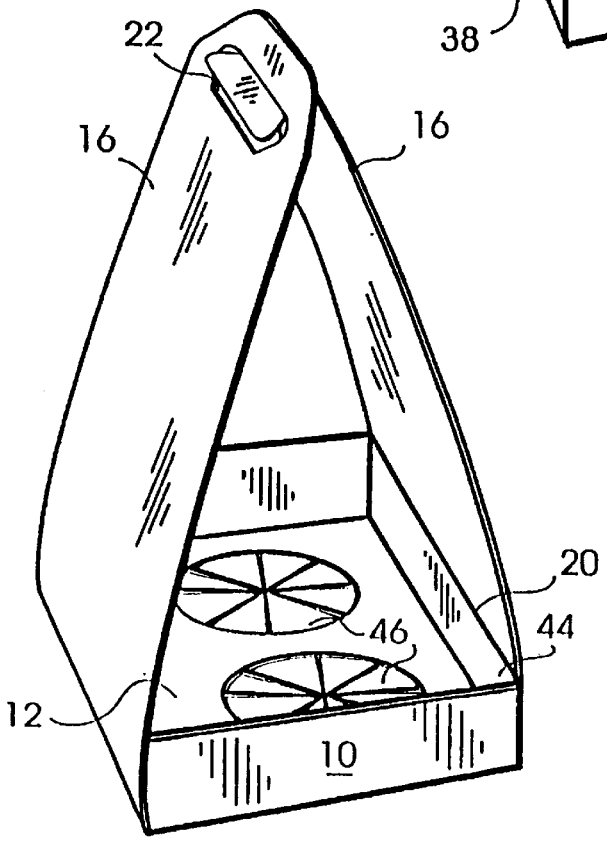
FIG. 2 is a front perspective view of an assembled beverage vessel carrier in a second, or alternate, configuration.
Figure 3:
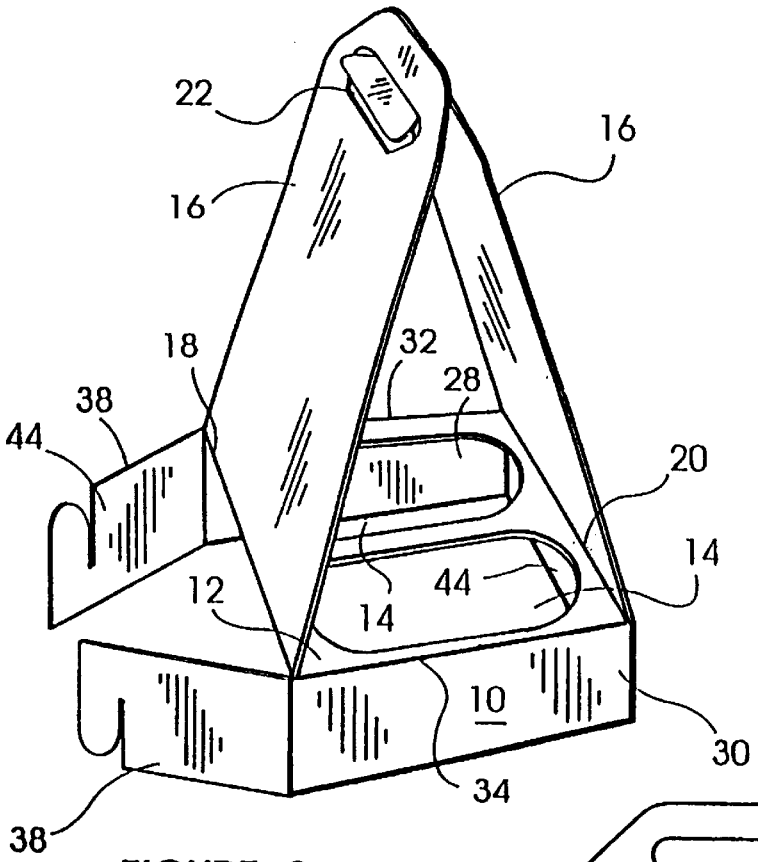
FIG. 3 is a front perspective view of the beverage vessel with the stabilizing arms yet to be interlocked.
Figure 4:
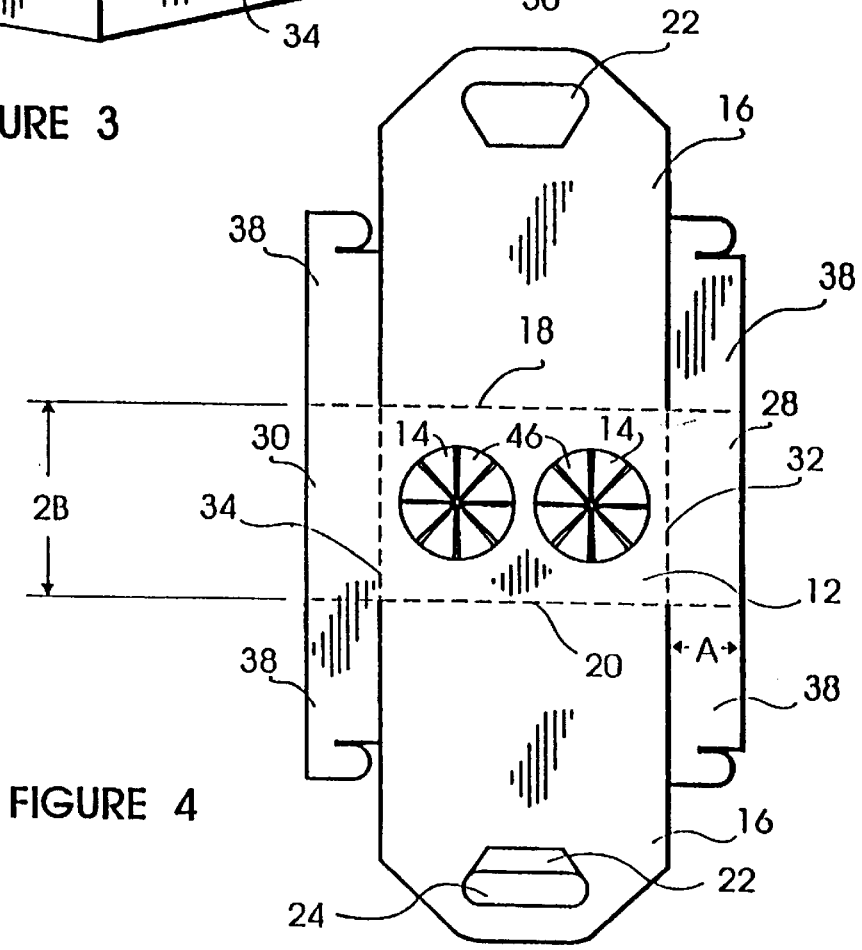
FIG. 4 is a plan view of a blank with fold lines marked.
Figure 5:
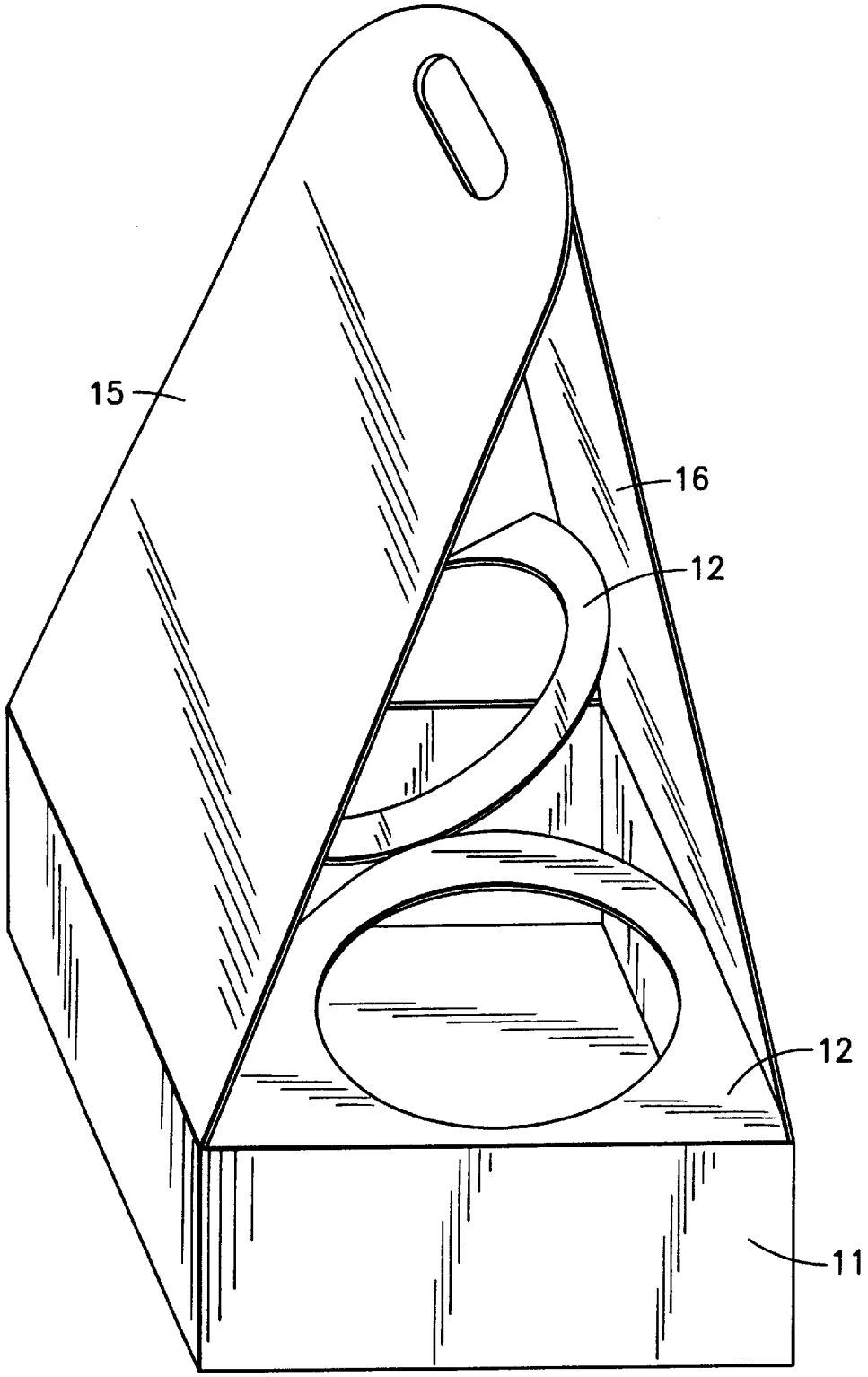
FIG. 5 is a perspective view of an assembled and folded for use food and cup carrier showing a two-place cup holder.

Referring to the figures, shown in FIG. 1 is a beverage vessel carrier 10. The present invention comprises a blank adapted to be folded into a box including a base 12 with at least one hole 14 having opposite base sides 18 and 20 and having opposite base ends 32 and 34 of width, 2B, and having end walls 28 and 30 depending from base ends 32 and 34. A pair of side wall arms 38 attach to each of the end walls 28 and 30, the width of the arms 38 on the end walls 28, 30 being within a distance, A, from the base ends 32, 34. Each side wall arm 38 is disposed to interlock with a side wall arm attached to an opposite end wall when the blank is folded, therein forming side walls 44. Thus, the end walls and side walls form an open box with the base as its bottom.

Side arms 38 are interlocked by means of matching slits in the side arms 38 with an arm from one end wall overlapping an opposing arm from an opposite end wall, a slit from one arm meshing with a matching slit in the other arm to form a side wall on each base side, the side and end walls forming a box with the base as its bottom.

A pair of handle panels 16 extend from opposite base sides 18, 20, one panel from each of the base sides, a distance from the base sides 18, 20 substantially greater than the sum of distances A and 2B such that the panels 16 are foldable alongside and around respective adjacent side walls 44 when the carrier is assembled, joining together at their distal ends to form a handle over the open box. The box is thereby covered by the handle panels 16 and supported by said handle panels from the box base 12 to form a triangular cavity over the base. Alternatively, the panels 16 are foldable away from respective side walls, similarly joining together over their distal ends to form a handle over the box base, the open box directed away from the handles.

Outward in each panel there are panel apertures 22 which meet to form a handle slot through which a user's hand or fingers can pass for lifting the base from the handle panels. In one panel there may be a handle interlocking portion 24 rotating into and upward into the aperture of the other handle panel aperture thereby engaging and interlocking the handle panels.

The base circular holes further comprise sectors 46 hinged at the circle arc or a chord approximating the arc, and radially cut to extend separately, to effectively cover the hole. Until depressed, the sectors 46 support foodstuffs generally, but when depressed, as by a cup inserted into the hole, the sectors hinge downward opening the hole to the cup.

Figure 6:
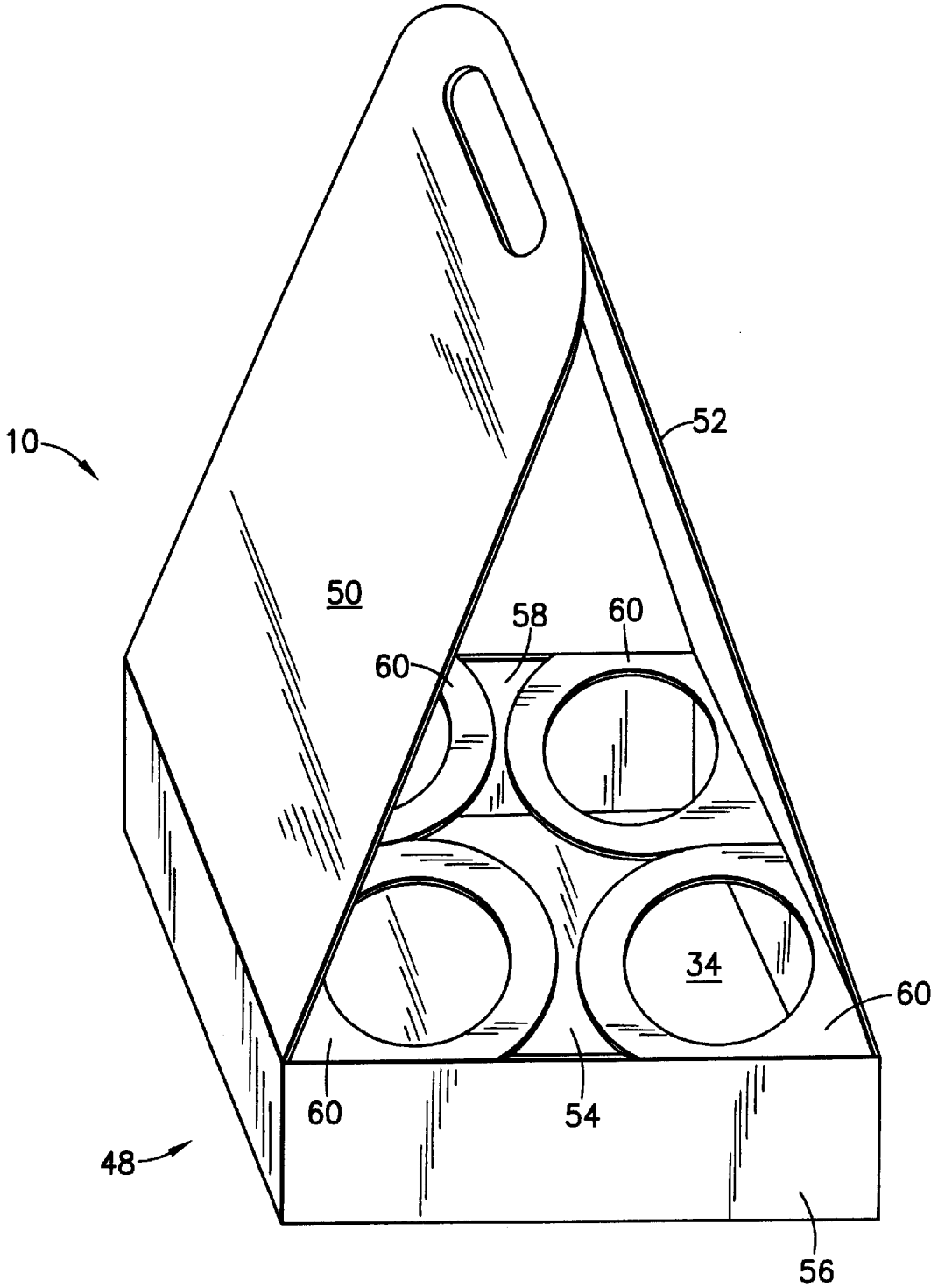
FIG. 6 is a perspective view of an assembled and folded for use food and cup carrier showing a four-place cup holder.

Referring now to FIG. 6, an alternative embodiment of a food and beverage carrier 10 is shown. A box-like structure 48 is formed from handle panels 50, 52, a bottom panel 54, and first and second side panels 56, 58. In order to stabilize cups that may be placed in box-like structure 48 one or more cup stabilizers 60 may be used, their position and operation being discussed below. Carrier 10 is intended to be made from paperboard having a thickness of about 0.018 inches, although slightly lighter or heavier material could be used. If light gauge material is used carrier 10 could be strengthened by using embossing techniques or utilizing double thickness at high stress points. Other materials such as corrugated or honeycomb composite structures could be used. A plastic or plastic laminate could be used as well.

Figure 7:
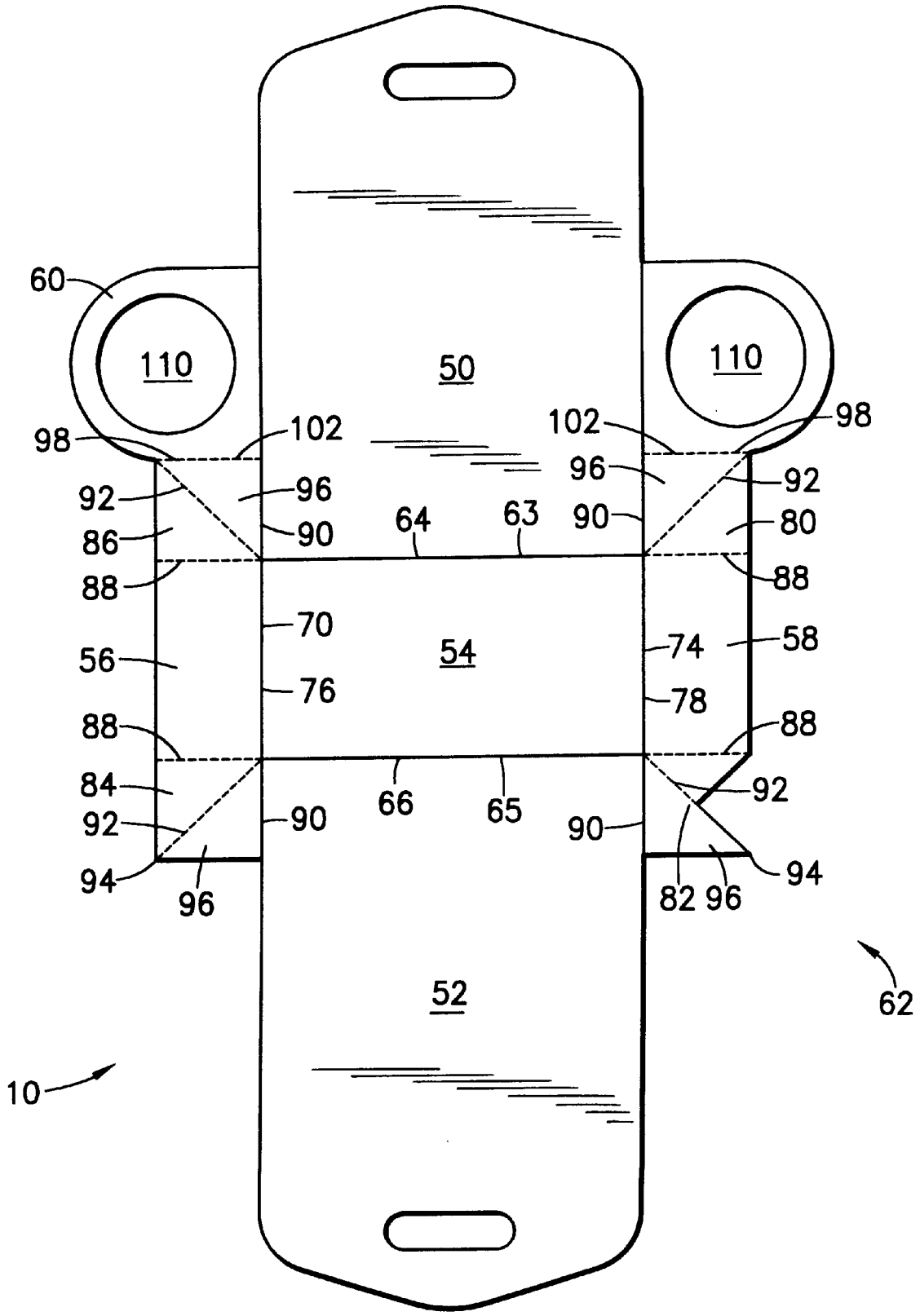
FIG. 7 is a plan view of a blank before folding and gluing into a food and cup carrier in a stored condition.

Referring now to FIG. 7, a carrier blank 62 is shown in plan view. Blank 62 is cut from stock described above by die or high pressure water or other customary means. By examining blank 62 it is apparent which edges of the various panels are formed in an integral manner. Alternatively, each of the various panels could be attached to the others by use of an adhesive or another suitable means, such as by stapling. Fold lines denoted as dashed lines are scored and may be perforated for ease of folding. Perforation is not required but enhances usefulness. Handle or end panel 50 is attached to or formed integral with an edge portion 63 of bottom panel 54 along fold line 64. Handle or end panel 52 is attached to or formed integral with an opposite edge portion 65 of bottom panel 54 along fold line 66. A first side panel 56 is attached or formed integral with bottom panel 54 along a side edge portion 70 of bottom panel 54. A second side panel 58 is attached or formed integral with bottom panel 54 along an opposite side edge portion 74 of bottom panel 54. Each side edge 70, 74 lies along a side fold line 76, 78.

Figure 8:
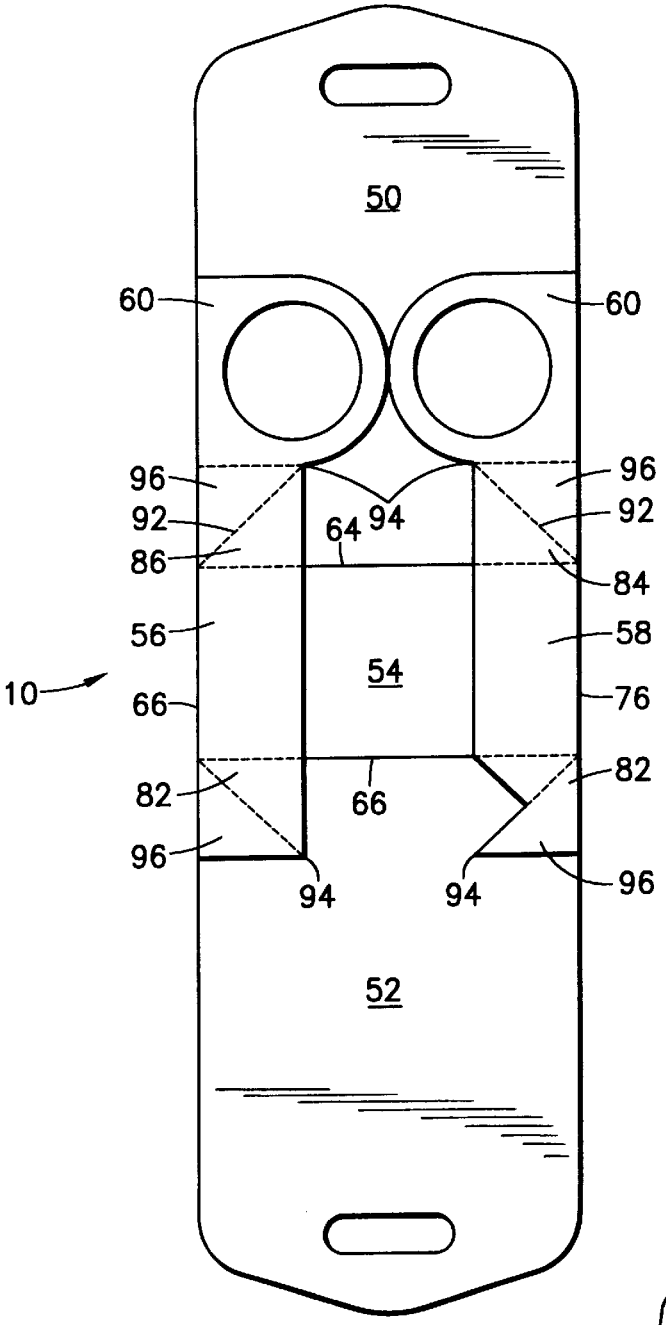
FIG. 8 is a plan view of a blank folded and glued into an as stored condition ready to be folded up into an in use condition.

Rectangular webs 80, 82, 84, 86 are attached or formed integral with respective side panels 56, 58 and handle panels 50, 52. Each web or gusset 80, 82, 84, 86 has a fold line 88 where it joins its respective side panel 56, 58 and a fold line 90 where it joins its respective handle panel 50, 52. Each web, or gusset 80, 82, 84, 86, being rectangular in shape, has a diagonal fold line 92 extending from its corner with bottom panel 54 to an outer corner 94. Diagonal fold lines 92 are preferably perforated and divide webs 80, 82, 84, 86 approximately in half, forming triangular pieces. Each web includes a web handle panel face 96. It is this face that gets glued to a respective handle panel 50, 52 during production. It has been found that when using stiffer materials, or thicker paperboard, or in certain sizes, that it is best to remove a triangular portion of each web as shown in FIGS. 7 and 8 in web 82. While only one web is shown in this manner it is understood that one or more webs can be modified in this manner to make folding into the in-use condition easier. The size of the piece of web removed is determined by the reduction in folding resistance and the necessary strength of the remainder to perform the function of connecting handle panels and side panels. This is also applicable to the embodiment shown in FIG. 10.

Attached or formed integral with one or more web edge portions 98 is one or more cup stabilizers 100. Cup stabilizer fold line 102 is preferably a perforated fold line. The cup stabilizers are attached along the one edge, that being web edge portion 98.

Figure 9:
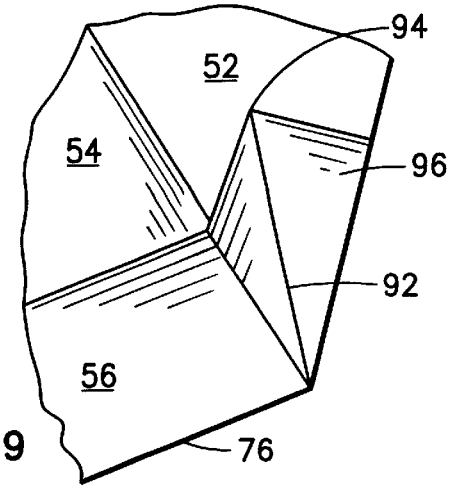
FIG. 9 is a partial pictorial showing one corner of a food and cup carrier with a web in a partially folded condition depicting the relationship between a side panel, a bottom panel, and a handle panel.

Referring now to FIG. 8, carrier 10 has been assembled by folding and gluing or stapling into its collapsed or stored condition. In this condition many carriers can be stored filling a relatively small volume and popped up into an in use condition when needed. Web handle panel face 96 is attached by gluing, adhesion, stapling, or the like, to each respective handle panel 50, 52. As shown in FIG. 9, as one or both side panels 56, 58 are pulled into an upright position, webs 80, 82, 84, 86 pull handle panels 50, 52 up into position. Webs are folded back on themselves until they are in a face to face contact position. Likewise, if handle panels 50, 52 are pushed into an upright condition, side panels 56, 58 will be pulled via webs into their upright position. The construction using webs provides a more stable and stronger carrier.

For use with beverage cups, cup stabilizers 100 can be folded down to provide a securing means part way up a cup with the bottom of the cup in contact with bottom panel 54. One or a plurality of cup stabilizers may be employed.

Figure 10:
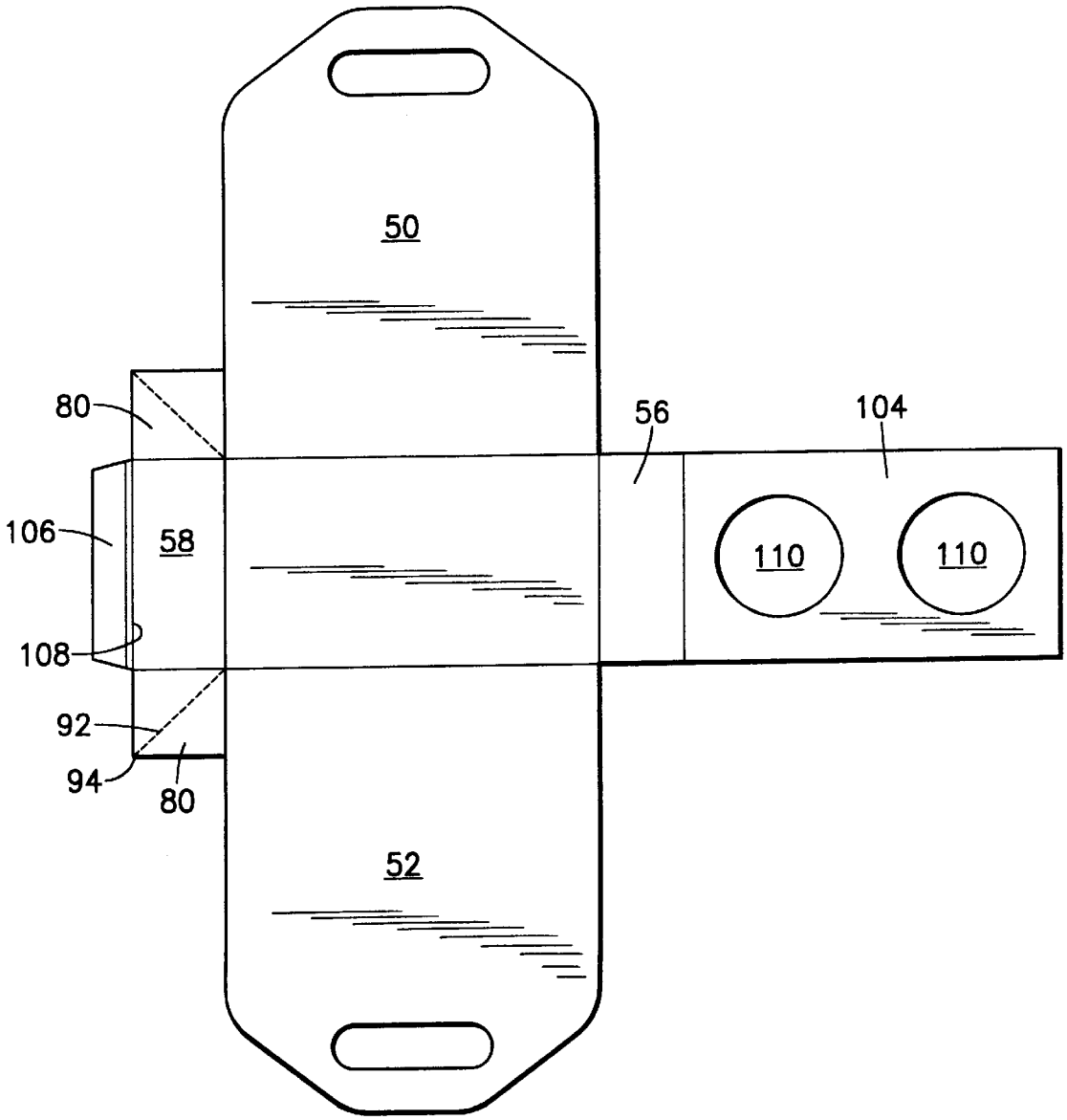
FIG. 10 is a plan view of another embodiment showing a blank ready for assembly having a pair of webs.

Referring now to FIG. 10, an alternate embodiment for a cup carrier only is shown. This design uses a pair of webs 80 on only one side of handle panels 50, 52. A cup stabilizer panel 104 is attached to a first side panel 56 that does not have any webs associated therewith. Cup stabilizer panel 104 includes at least one opening 110 sized to receive a cup. Cup stabilizer panel 104 is attached to a tab 106 that is in turn attached via a fold line to a top edge 108 of a second side panel 58. Second side panel 58 has associated webs 80 as described above. In operation this embodiment only requires a gentle pull on second side panel 58 or cup opening 110 to raise both handle panels 50, 52 and the first side panel 56.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

INDUSTRIAL APPLICATION

The present invention is very useful for conveying or carrying food and beverages from carry-out types of vendors, such as can be found at public stadiums, street vendors, or the like. The invention enables one person to carry one or more beverages and/or food with one hand leaving the other hand free to open doors or get keys out.

What is claimed is:

1. A food and beverage carrier comprising:

a box-shaped structure having a bottom panel, a first side panel and a second side panel, said first side panel having a fold line along an edge with said bottom panel, said second panel having a fold line along an opposite edge of said bottom panel, said edge of said first side panel is attached to a first side panel portion of said bottom panel, said edge portion of said second panel attached to a second panel portion of said bottom panel;

a first end panel and a second end panel, each of said end panels having a top edge portion and a bottom edge portion, said first end panel's bottom edge attached to a first end panel portion of said bottom panel, and said second end panel's bottom edge attached to a second end panel portion of said bottom panel;

a plurality of webs, each web having a fold line extending from one corner to another corner thereof, each of said webs having an edge portion thereof attached to an edge portion of their respective first or second side panels, and each web having an end panel contact face, said contact face being attached to respective end panels thereby connecting respective side and end panels such that when either side panel is folded up into an in use condition said end panels are pulled up by said webs, said webs folding in half along their respective diagonal fold lines forming said box-shaped structure; and wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line to one of said webs.

2. A food carrier according to claim 1, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said handle panels.

3. A food carrier according to claim 1, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said side panels.

4. A food and beverage carrier comprising:

a bottom panel, first and second side panels attached to opposite sides of said bottom panel, first and second handle panels attached to opposite sides of said bottom panel not attached to said first and second side panels, a plurality of webs attached on one edge to a respective edge of said side panels, said webs and said side panels are folded inwardly along a respective fold line between said side panels and said bottom panel and said webs and said handle panels with said side panels contacting said bottom panels and said webs further attached by a portion of each web's handle panel faces to respective handle panels, said carrier remaining in a substantially flat condition in this arrangements said webs including a diagonal fold line such that when said side panels are folded into an upright condition along said respective fold line between said side panels and said bottom panel said handle panels are simultaneously pulled into an upright position by said webs folding into face contact along their diagonal fold lines forming a box-shaped structure with handle panels extending upwardly from said bottom panel in an in use condition having a substantially open top.

5. A food carrier according to claim 4, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said webs.

6. A food carrier according to claim 4, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said end panels.

7. A food carrier according to claim 4, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said side panels.

8. A food and beverage carrier comprising:

a bottom panel, first and second side panels formed integral with opposite sides of said bottom panel, first and second handle panels formed integral with opposite sides of said bottom panel not attached to said first and second side panels, said side and handle panels having a fold line where they join with said bottom panel, a plurality of webs formed integral with edge portions of said side panels and an edge portion of said webs' respective handle panels, said webs having a panel contact face at least partially attached to respective handle panel faces when said side panels and webs are folded inwardly along said fold lines forming a substantially flat carrier in a stored condition, said webs further including a perforated diagonal fold line such that when side panels are pulled upwardly and outwardly along said fold lines into an upright condition said handle panels are pulled into an upright position by said webs folding into face contact along their diagonal fold lines forming a box-shaped structure with handle panels extending vertically from said bottom panel in a condition ready to receive food or beverages.

9. A food carrier according to claim 8, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said webs.

10. A food carrier according to claim 8, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said end panels.

11. A food carrier according to claim 8, wherein at least one cup stabilizer is provided adapted to fold down over said box-shaped structure, said cup stabilizer being spaced above said bottom panel, said cup stabilizer having an opening sized to accept a cup therethrough, and said cup stabilizer being attached via a fold line with one of said side panels.

12. A blank for forming a food and beverage carrier comprising:

a bottom elongated panel having a longitudinal axis and elongated spaced side edges and integral interconnected spaced side edges;

a first elongated end panel having a longitudinal axis connected to an edge of bottom panel along a fold line;

a second elongated end panel having a longitudinal axis connected to an edge of bottom panel along a fold line;

a first side panel extending in a direction normal to the longitudinal axis of said bottom panel connected to said edge of bottom panel along a fold line;

a second side panel extending in a direction normal to the longitudinal axis of said bottom panel connected to said edge of said main panel along a fold line;

a pair of webs foldably connected along fold lines at opposite ends of each side panel, the fold line of one of said webs being aligned with said fold line of said main panel and with the fold line of the other of said webs, the fold line of the other of said webs being aligned with the fold line of said bottom panel and with the fold line of the other of said webs, each of said webs being substantially bisected by a fold line and foldably interconnected along a fold line to each of said end panels on opposite sides thereof, and a pair of apertured panels, each panel foldably connected along fold lines on opposite sides of one of said end panels to respective ones of said webs.

* * * * *